US006240901B1

(12) United States Patent
Jay

(10) Patent No.: US 6,240,901 B1
(45) Date of Patent: Jun. 5, 2001

(54) FUEL FEEDING SYSTEM

(75) Inventor: David C. Jay, Vähäkyrö (FI)

(73) Assignee: Wartsila NSD Oy AB, Helsinki (FI)

( * ) Notice: Subject to any disclaimer, the term of this patent is extended or adjusted under 35 U.S.C. 154(b) by 0 days.

(21) Appl. No.: 09/314,640

(22) Filed: May 19, 1999

(30) Foreign Application Priority Data

May 20, 1998 (FI) ..... 981126

(51) Int. Cl.[7] ..... F02M 7/00
(52) U.S. Cl. ..... 123/446; 123/447
(58) Field of Search ..... 123/446, 447, 123/456; 417/439, 493, 505

(56) References Cited

U.S. PATENT DOCUMENTS 3,827,409 * 8/1974 O'Neill ..... 123/32
4,784,101 * 11/1988 Iwanaga et al. ..... 123/446
4,884,545 * 12/1989 Mathis ..... 123/447
5,183,019 * 2/1993 Suhara ..... 123/339
5,230,613 7/1993 Hilsbos et al. ..... 417/439
5,433,182 * 7/1995 Augustin et al. ..... 123/456

* cited by examiner

*Primary Examiner*—Henry C. Yuen
*Assistant Examiner*—Mahmoud M Gimie
(74) *Attorney, Agent, or Firm*—John Smith-Hill; Smith-Hill and Bedell

(57) ABSTRACT

A fuel feeding system for a multi-cylinder engine, especially a large diesel engine, includes at least two high pressure pumps for feeding fuel from a fuel tank into respective pressure accumulator units, each of which defines a pressure chamber which is connected to at least two injectors. A passage interconnects the pressure chambers of the pressure accumulator units without obstruction. An auxiliary valve is attached to one of the pressure accumulator units for selectively connecting the pressure chamber of that pressure accumulator unit to the fuel tank.

11 Claims, 1 Drawing Sheet

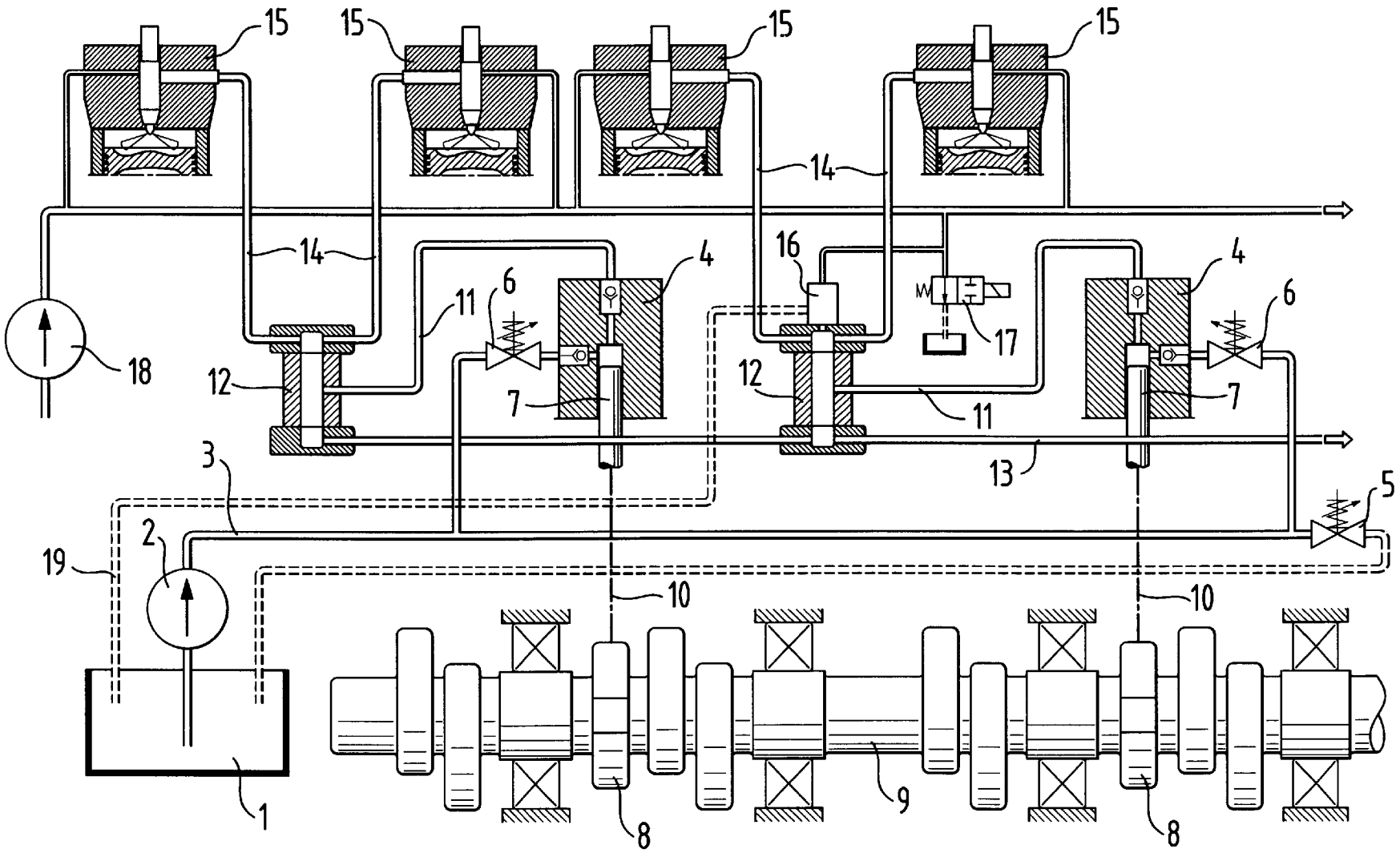
1
2
3
4
5
6
7
8
9
10
11
12
13
14
15
16
17
18
19

FUEL FEEDING SYSTEM

BACKGROUND OF THE INVENTION

The invention relates to a fuel feeding system for a multi-cylinder engine, especially a large diesel engine, in which the fuel is fed from a fuel tank by means of a high pressure pump into a pressure supply, from which it is fed further by means of injectors into the cylinders of the engine. Large diesel engines refer here to such engines that are applicable for instance for main propulsion engines or auxiliary engines for ships or for power plants for production of heat and/or electricity.

In a modern diesel engine, fuel is injected by means of fuel injecting valves or injectors directly into the cylinders of the engine. Since the injection occurs at a relatively late phase at the end part of the compression stroke, a sufficiently high pressure is correspondingly necessary for the injection. In a conventional fuel feeding system each cylinder is provided with an injection pump of its own which pumps fuel through an injection valve and an injection nozzle into the combustion chamber of the cylinder. The arrangement is expensive since it includes many separate components. In addition the pressure in the injection pumps may vary, whereby the injection into the different cylinders may correspondingly take place under different pressures and provide different amounts of fuel.

A newer solution is a so-called common rail or common pressure injection, in which the generation of pressure and the injection of fuel are functionally separated from each other. Fuel is fed by means of a high pressure pump into a common pressure supply, from which it is led through separate pipes to the respective injectors of the several cylinders. In practice the operation of an injector is electronically controlled for instance by means of a solenoid valve in order to obtain a sufficiently short and precise injection.

Especially in large engines the common rail system is attended by certain drawbacks as a consequence of the length of the common fuel rail serving as a pressure supply, since depending of the type of engine the length may be 3 m or even more. If the common fuel rail is long and narrow, severe pressure waves or pressure pulses moving back and forth appear easily in it. These affect correspondingly the amount of fuel injected into the several cylinders. In addition due to the high pressures involved the strength of a long fuel rail and thus the security of the system may become a problem. On the other hand if the common fuel rail is long and has a relatively large diameter so as to prevent the pressure waves mentioned above and the fuel rail is cooled, reheating of the fuel to its operating temperature takes longer than in the case of a narrow fuel rail. This may be a problem especially when heavy fuel oils are utilized.

SUMMARY OF THE INVENTION

The aim of the invention is to provide a new and improved fuel feeding system, which is applicable especially to large diesel engines and from which the problems evident in the known solutions, as mentioned above, are eliminated. The aim of the invention is to provide a fuel feeding system which enables the fuel pressure to be maintained more constant than before and which is as a whole more secure and reliable than before and yet advantageous as to its costs.

In accordance with the invention the pressure chambers of the pressure accumulator units are continuously in connection with each other. In addition one of the pressure accumulator units is provided with an auxiliary valve by means of which the pressure chamber of that pressure accumulator unit, and at the same time the pressure chambers of the other pressure accumulator units connected thereto, can be connected to the fuel tank. This enables circulation of fuel for instance for heating thereof before starting of the engine, which is of importance especially when heavy fuel oil is utilized. By means of a solution according to the invention it is possible to avoid utilization of a long common fuel rail, and yet the solution makes it possible to effectively balance the possible pressure differences among the separate pressure accumulator units. The strength of the construction is no problem either in this case so the system is more reliable and secure than before.

The system includes with advantage a low pressure pump for feeding fuel from the fuel tank to the high pressure pumps which in turn feed fuel to the pressure accumulator units. The fuel feeding system is divided into a low pressure feeding circuit to which fuel is fed by the low pressure pump and a high pressure circuit to which fuel is fed by the high pressure pumps. The feeding circuit may be provided with a throttle means, a constant pressure valve or the like for maintaining a uniform feeding pressure. In practice the pressure in the feeding circuit may with advantage be 5–10 bar. Since part of the fuel feeding system is under low pressure, the part that is under high pressure (the high pressure circuit) can to a large degree be limited, which improves the reliability of the system and decreases costs, since the components for the low pressure part are simpler and less expensive.

Each high pressure pump is with advantage provided with a control valve, by means of which the volume flow provided by the high pressure pump is controlled and by means of which the connection between the high pressure pump and the low pressure pump can additionally be closed. In addition by opening and closing the control valves it is possible to ensure that the fuel flow takes place through all the pressure accumulator units even if there is a blockage somewhere in the system. Consequently, when heating the fuel it is possible to ensure that all the fuel in the pressure accumulator units is heated and that there are no dead spaces containing unheated fuel.

The auxiliary valve may with advantage serve also as a constant pressure valve and it may be utilized in order to unpressurize the pressure accumulator units when necessary.

The fuel pressure in a pressure accumulator unit is about 800–1600 bar, preferably 1000–1400 bar. When a pressure accumulator unit is connected to at least two injectors the volume of its pressure chamber can with advantage be defined on the basis of the formula:

$$S=Vtot/(Vinj*Ncyl)$$

in which

Vtot=the common volume of all the pressure accumulator units of the engine;

Vinj=the amount (volume) of fuel injected by one injector for one combustion occurrence of a cylinder, under full (100%) engine load;

Ncyl=the number of cylinders in the engine;

so that the value of S is in the range of 50–100.

The pressure accumulator units are connected to each other by means of a pipe or a duct connected from one unit to another and the diameter of which is then with advantage 4.5–5.0 mm, preferably about 4.7 mm. These dimensioning parameters can affect the extent of vibrations and pressure waves possibly occurring in the system and they are dependent on the construction of the system in each case. The diameter of the connecting pipe is in practice a compromise whereby different features and properties such as dampening of pressure waves and the need to circulate fuel before starting the engine should be taken account of.

The high pressure pump is driven by a cam included in a cam shaft of the engine. The cam may have multiple lobes.

BRIEF DESCRIPTION OF THE DRAWINGS

In the following the invention is described, byway of example, with reference to the attached drawing, the only figure of which shows schematically an embodiment of a fuel feeding system according to the invention.

DETAILED DESCRIPTION

In the drawing 1 indicates a fuel tank, from which fuel is pumped by means of a low pressure pump 2 along a fuel line 3 to high pressure pumps 4. The fuel line 3 is under relatively low constant pressure, for instance about 7 bar. The fuel line is provided with a constant pressure valve 5, through which the line 3 can be reconnected to the fuel tank 1. A simpler throttle member may be utilized to maintain a constant pressure instead of a constant pressure valve in the fuel line 3.

The high pressure pumps 4 are provided with control valves 6 and piston members 7. The piston members 10 are driven by cam members 8 of a cam shaft 9 of the engine. When necessary, each cam member 8 may include several lobes, whereby the high pressure pump executes several pumping cycles for one revolution of the cam shaft. Since the size of the pump depends on the volume flow per pumping cycle, for a given volume flow per time unit into a pressure accumulator unit, this allows the outer dimensions of the pump to be smaller than if the pump executed only one pumping cycle per revolution of the cam shaft. Moreover, the pressure shocks provided by the pump are smaller.

Each high pressure pump 4 is connected by means of a high pressure line 11 to its own separate pressure accumulator unit 12, which for its part is connected by means of pipes or ducts 14 to electronically controlled injectors installed for two or more cylinders of the engine. The pressure accumulator units 12 are connected to each other by means of a pressure equalizing pipe 13 for decreasing possible pressure differences between the accumulators. In practice the pressure prevailing in the high pressure line 11 and in the pressure accumulator units 12 is about 1,200 bar, but if required it may be varied preferably within the range of 1,000–1,400 bar. Temporarily the pressure may even rise as high as 1,600 bar. When desired the operation of the high pressure pumps 4 and the injection pressures to be used can be controlled in accordance with engine load, operating speed and other parameters in known manner.

One pressure accumulator unit 12 in the system is provided with an auxiliary valve 16, the operation of which is controlled using a precontrol valve 17 connected to a servo oil circuit of the engine. A servo oil pump 18 maintains a pressure of about 100 bar in the servo oil circuit and the servo oil circuit is also used in conjunction with a conventional solenoid valve (not shown) to control the injection of fuel by the injectors 15. In one condition of the valve 17, the valve 16 is closed, whereas in the other condition of the valve 17, the valve 16 is open and connects the pressure accumulator units 12 of the system to the fuel tank 1 through a line 19. Thus, when necessary, by means of the valve 16 the pressure accumulator units 12 may be unpressurized. In addition the valve 16 makes it possible to circulate fuel, for instance for the purpose of heating the fuel before starting the engine. When desired, by opening and closing the control valves 6 in turn it is also possible to ensure by means of the valve 16 that the fuel flow takes place through all the pressure accumulator units 12. Further the valve 16 may with advantage serve as a constant pressure valve, for the high pressure circuit also needs a constant pressure valve in any event.

In the embodiment shown the volume of the pressure chamber of each pressure accumulator unit 12 may with advantage be about 0.7 liter and the diameter of the pipe connecting the accumulators together may be about 4.7 mm. These dimensions are most suitable for the case in which the injection into each cylinder is about 4700 $mm^3$ at full power and full load of the engine, and they are suitable for their part to eliminate possible pressure pulses between the accumulators.

For the matter of clarity the figure shows only two pressure accumulator units 12, which feed fuel to injectors installed for injecting fuel into four cylinders of the engine. The system according to the invention may naturally be applied to a multi-cylinder engine independent of the number of cylinders. Similarly, when desired, one pressure accumulator unit may feed fuel also for e.g. three cylinders. This should naturally be taken account of when dimensioning the system.

The invention is not restricted to the embodiment shown, but several modifications are feasible within the scope of the attached claims.

What is claimed is:

1. A fuel feeding system for a multi-cylinder engine, especially a large diesel engine, comprising:

a means defining a high pressure supply space for receiving fuel, a high pressure pump means for feeding fuel from a fuel tank into the high pressure supply space, and at least four injectors connected to the high pressure supply space for injecting fuel into the cylinders of the engine, and wherein the means defining the high pressure supply space includes at least two pressure accumulator units, each of which defines a pressure chamber which is connected to at least two injectors, and a pressure equalizing duct interconnecting the pressure chambers of the pressure accumulator units without obstruction, the high pressure pump means includes at least two high pressure pumps, one for each pressure accumulator unit to be connected thereto, for feeding fuel from the fuel tank into the pressure chambers of the respective pressure accumulator units, and the fuel feeding system further comprises an auxiliary valve attached to one of the pressure accumulator units for selectively connecting the pressure chamber of said one pressure accumulator unit to the fuel tank.

2. A fuel feeding system according to claim 1, including a low pressure pump for feeding fuel from the fuel tank to the high pressure pumps.

3. A fuel feeding system according to claim 1, including a low pressure pump having a feeding circuit for feeding fuel from the fuel tank to the high pressure pumps, and wherein the feeding circuit is provided with a means for maintaining a uniform pressure in the feeding circuit.

4. A fuel feeding system according to claim 1, including a low pressure pump having a feeding circuit for feeding fuel from the fuel tank to the high pressure pumps, and wherein the pressure in the feeding circuit is 5–10 bar.

5. A fuel feeding system according to claim 1, wherein each high pressure pump is provided with a control valve for controlling volume flow provided by the high pressure pump and by means of which the high pressure pump can be disconnected from the low pressure pump.

6. A fuel feeding system according to claim 1, wherein said auxiliary valve serves also as a constant pressure valve.

7. A fuel feeding system according to claim 1, wherein the fuel pressure in the pressure accumulator units is about 800–1,600 bar, preferably 1,000–1,400 bar.

8. A fuel feeding system according to claim 1, wherein the volume of the pressure chamber of a pressure accumulator unit connected to at least two injectors is defined on the basis of the formula:

$$S=Vtot/(Vinj*Ncyl)$$

in which

Vtot=the common volume of all the pressure accumulator units;

Vinj=the amount (volume) of fuel injected by one injector for one combustion occurrence of a cylinder, under full (100%) engine load;

Ncyl=the amount of cylinders in the engine;

so that the value of S is in the range of 50–100.

9. A fuel feeding system according to claim 1, wherein the pressure accumulator units are connected to each other by means of a pressure equalizing pipe connected from one unit to another and having an internal diameter of 4.5–5.0 mm, preferably about 4.7 mm.

10. A fuel feeding system according to claim 1, wherein each high pressure pump is driven by a cam included in a cam shaft of the engine.

11. A fuel feeding system according to claim 10, wherein the cam has multiple lobes.

* * * * *